US006116128A

United States Patent [19]

Long

[11] Patent Number: 6,116,128

[45] **Date of Patent: *Sep. 12, 2000**

[54] METHOD FOR PRODUCING A ROUNDED CORNER AT EACH CORNER OF A PILE OF SHEETS

[75] Inventor: Michael Long, Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/060,803

[22] Filed: Apr. 15, 1998

Related U.S. Application Data

[62] Division of application No. 08/907,283, Aug. 6, 1997, abandoned, which is a continuation of application No. 08/211,841, filed as application No. PCT/EP92/02429, Oct. 22, 1992, abandoned.

[30] Foreign Application Priority Data

Oct. 28, 1991 [FR] France ..... 91 13547

[51] Int. Cl.[7] ..... B26D 3/10

[52] U.S. Cl. ..... 83/39; 83/207; 83/220; 83/256; 83/468.93

[58] Field of Search ..... 83/918, 648, 451, 83/912, 206, 207, 282, 869, 468.93, 917, 934, 35, 39, 220, 256, 404.2, 405, 406, 469.8, 468.94; 271/221, 222

[56] References Cited

U.S. PATENT DOCUMENTS

| | | |
|---|---|---|
| Re. 16,779 | 11/1927 | Maxner . |
| 224,475 | 2/1880 | Pringle . |
| 473,859 | 4/1892 | Taylor . |
| 670,067 | 3/1901 | Southworth . |
| 744,891 | 11/1903 | Allen . |
| 968,014 | 8/1910 | White . |
| 1,107,859 | 8/1914 | Stevens . |
| 1,527,755 | 2/1925 | Spaulding . |
| 1,743,921 | 1/1930 | Kerley . |
| 2,082,867 | 6/1937 | Andersen . |
| 2,122,186 | 6/1938 | Southworth . |
| 2,163,868 | 6/1939 | Christie . |
| 2,175,461 | 10/1939 | Gylleck et al. . |
| 2,626,801 | 1/1953 | Uriell . |
| 3,125,920 | 3/1964 | Smith . |
| 3,159,398 | 12/1964 | Buccicone . |
| 3,165,956 | 1/1965 | Thumim . |
| 3,222,060 | 12/1965 | Svantesson . |
| 3,357,289 | 12/1967 | Thomson . |
| 3,370,848 | 2/1968 | Bartlett . |
| 3,496,814 | 2/1970 | Bessim . |
| 3,563,360 | 2/1971 | Wickersheim . |
| 3,724,089 | 4/1973 | Thompson et al. . |
| 3,737,051 | 6/1973 | Horino . |
| 3,739,672 | 6/1973 | Pfaffle . |
| 3,779,118 | 12/1973 | Habanec . |
| 3,815,259 | 6/1974 | Atwood et al. . |
| 3,945,095 | 3/1976 | Herold et al. . |
| 4,132,400 | 1/1979 | Naramore . |
| 4,312,254 | 1/1982 | Pearl . |
| 5,022,297 | 6/1991 | Hommes et al. . |
| 5,211,090 | 5/1993 | Rathert . |
| 5,295,309 | 3/1994 | Kozlowski et al. . |

FOREIGN PATENT DOCUMENTS

| | | |
|---|---|---|
| 3410000 | 3/1984 | Germany . |
| 4104428 | 10/1991 | Germany . |

*Primary Examiner*—Kenneth E. Peterson
*Attorney, Agent, or Firm*—Susan L. Parulski

[57] ABSTRACT

A method used for rounding the corners of a pile of sheets. Air is injected between the sheets in the pile to create a lubricating fluid film between the sheets; at least one of the corners of the pile is placed in abutment against two reference surfaces formed facing at least one corner of the pile, and the four cutting devices corresponding to each corner are actuated.

3 Claims, 7 Drawing Sheets

METHOD FOR PRODUCING A ROUNDED CORNER AT EACH CORNER OF A PILE OF SHEETS

CROSS REFERENCE TO RELATED APPLICATION

This is a Divisional of U.S. Ser. No. 08/907,283 filed Aug. 6, 1997, now abandoned, which is a Continuation of U.S. Ser. No. 08/211,841 filed Apr. 18, 1994, now abandoned, which was based on PCT/EP 92/02429 filed Oct. 22, 1992 which claims priority of FR 91 13547 filed Oct. 28, 1991.

FIELD OF THE INVENTION

The invention relates to a method for producing a rounded corner at each corner of a pile of sheets, and is particularly suited to products such as X-ray films. The present invention relates also to apparatus enabling the method according to the invention to be implemented.

BACKGROUND OF THE INVENTION

It is known that materials in sheets such as X-ray films or cards such as bank cards must have rounded corners.

According to a first known technique, such rounded corners are produced by making notches initially, having the shape of the rounded corner common to two adjacent sheets, on the edges of a moving strip and then cutting the strip in the middle of the said notch. The problem with such a technique lies in the difficulty in positioning the cutting device correctly with respect to the centre of the notch. In fact, the slightest error in the positioning of the cutting device will result in an incomplete rounded corner on one of the sheets and an unwanted strip at the end of the other sheet.

Another known technique involves stopping the process while positioning and producing the rounded corners on the sheet which has just been cut. This technique is of course detrimental from the point of view of productivity.

There are also other systems, such as line rotating systems, but which have great problems related to the complexity of the operations required for passing from one format to another.

FIG. 1, to which reference is now made, illustrates another known type of device enabling the corners of a pile of sheets to be rounded.

The device shown comprises principally an inclined plane 1 on which the sheets 2 are positioned, two reference surfaces 3, 4 at right angles to each other being provided on the said inclined plane 1 and against which the sheets are positioned under the effect of gravity. Advantageously vibration is applied to the reference surfaces so as to permit a better positioning of the sheets against the two reference surfaces 3, 4. The reference surfaces are separated from the bottom corner of the inclined plane 1 so as to be able to dispose a cutting tool between the said two reference surface 3, 4, the said cutting tool being designed so as to produce the desired shape of the rounded corner. In the example shown, the cutting device 5 comprises a curved blade movable in a reciprocating motion in the direction shown diagrammatically by the two directional arrows 6. The rounded corners in each corner of the pile are produced successively by moving the said pile manually.

The main problem with such a device lies in the positioning of the sheets against the reference surfaces. The device shown in FIG. 1 functions satisfactorily when the sheets in the pile are, initially, relatively well aligned so that the length of each sheet protruding beyond the edge of the normal alignment of the pile is sufficiently small to withstand a force applied axially without causing any deformation of the sheets with respect to the surface of the inclined plane 1.

SUMMARY OF THE INVENTION

It is obvious that such a method is limited to applications in which the sheets are relatively rigid and relatively well aligned initially and in which the friction between the sheets is sufficiently small. In the context of the manufacture of photographic films, such as X-Ray products, in addition to these limitation there is a fact that the photosensitive layers on the photographic products can be damaged by the abrasion between the sheets and, particularly at the edges in contact with the reference surfaces 3, 4, because of the forces resulting from this contact. Thus one of the objects of the present invention is to provide a method making it possible to produce a rounded corner at each of the corners of a pile of sheets, without damaging the said sheets when the pile is positioned with respect to the cutting tools.

Another object of the present invention is to provide a device enabling the method according to the present invention to be implemented.

Yet another object of the present invention is to provide a method and an apparatus making it possible to produce rounded corners at the four corners of a pile of sheets, at least one of the dimensions of which (length and/or width) may be variable from one sheet to another in the pile.

These objects are achieved by means of a method for producing rounded corners at the four corners of a pile of sheets of substantially equal dimensions by means of an apparatus comprising four cutting devices disposed at the four corners of a substantially rectangular surface and means suitable for positioning the sheets correctly with respect to the cutting devices against components defining two reference surfaces at right angles to each other at at least one corner of the substantially rectangular surface, the method comprising the following steps:

a) injecting air between the sheets in the pile so as to create a lubricating fluid film between the sheets in the pile;

b) placing at least one of the corners of the pile in abutment against the two reference surfaces of at least one of the corners of the substantially rectangular surface comprising such reference surfaces; and c) actuating the four cutting devices so as to produce the desired rounded corner at each of the four corners.

According to another embodiment of the present invention, a method is provided for producing, in pairs, rounded corners at the four corners of a pile of sheets having one of their dimensions (length or width) variable from one sheet to another in the pile, the other dimension being substantially constant for all the sheets in the pile, by means of an apparatus comprising four cutting devices disposed at the four corners of a substantially rectangular surface and means suitable for accurately positioning the sheets with respect to the cutting devices against two reference surfaces at right angles to each other formed at one corner of each of the ends of the substantially rectangular surface along the axis of the variable dimension of the sheets, the method comprising the following steps:

a) injecting air between the sheets in the pile so as to create a lubricating fluid film between the sheets;

b) placing a first corner of the pile in abutment against the two reference surfaces of the first end of the substantially rectangular surface;

c) actuating the cutting device simultaneously at each corner of the first end of the substantially rectangular surface;

d) placing a second corner of the pile in abutment against the two reference surfaces of the second end of the said substantially rectangular surface; and e) actuating the cutting device simultaneously at each corner of the second end of the substantially rectangular surface.

According to yet another embodiment of the present invention, rounded corners are produced successively at the four corners of a pile of sheets by means of an apparatus comprising four cutting devices disposed at the four corners of a substantially rectangular surface and means suitable for successively positioning the sheets with respect to each of the cutting devices against two reference surfaces at right angles to each other provided at each corner of the substantially rectangular surface, the method comprising the following steps:

a) injecting air between the sheets in the pile so as to create a lubricating fluid film between the sheets in the pile;

b) moving the pile of sheets, in two directions at right angles to each other, so as to press a first corner of the pile against the two corresponding reference surfaces;

c) actuating the cutting device corresponding to the corner so as to produce the desired rounded corner; and d) repeating steps b) and c) for the other three corners.

The method according to the present invention is implemented by means of a device making it possible to produce rounded corners at the four corners of a pile of sheets comprising four cutting devices making it possible to produce the desired shape of the rounded corner and disposed at the four corners of a substantially rectangular surface, and means suitable for correctly positioning the sheets with respect to the cutting devices, the apparatus being characterized in that said positioning means comprise:

a) means intended to direct air over substantially the entire height of at least one of the edges of the pile in order to inject air between the sheets in the said pile;

b) components forming a stop disposed so as to define, at at least one corner of the said substantially rectangular surface, two reference surfaces at right angles to each other; and c) components which are movable in translation, disposed facing and substantially perpendicular to at least two sides of the pile and acting so as to position at least one corner of the pile against the two reference surfaces of at least one corner of the said substantially rectangular surface.

According to another embodiment of the apparatus, the sheets in the pile have one of their dimensions (length or width) variable from one sheet to another in the pile, the other dimension being substantially identical for all the sheets in the pile, the stop means being disposed so as to form two reference surfaces at one corner of each end of the pile along the axis of the variable dimension of the said sheets, movable components being disposed facing and substantially perpendicular to at least three sides of the pile and acting so as to successively push two corners of the pile in two directions at right angles to each other against the two reference surfaces corresponding to the corners of the substantially rectangular surface comprising such reference surfaces.

According to yet another embodiment, the stop means are disposed so as to form two reference surfaces at each corner of the said substantially rectangular surface, the movable components being disposed facing and substantially perpendicular to the four sides of the pile and acting so as to push each corner of the pile successively in two directions at right angles to each other against the two reference surfaces of the corresponding corner of the said substantially rectangular surface.

BRIEF DESCRIPTION OF THE DRAWINGS

In the detailed description which follows, reference will be made to the drawing in which.

DETAILED DESCRIPTION OF THE INVENTION

Figure 1:
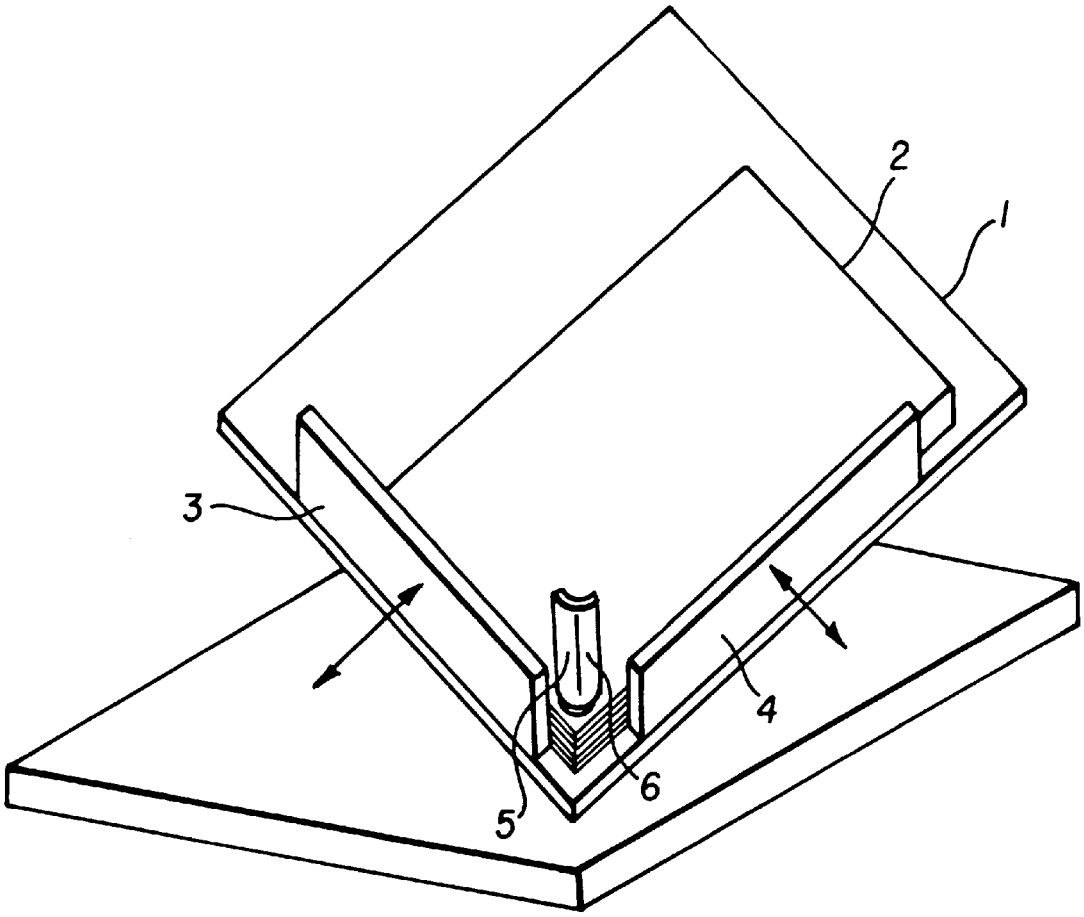
FIG. 1 (PRIOR ART)
FIG. 1 shows a conventional prior art device for producing rounded corners at the four corners of a pile of sheets.
Figure 2:
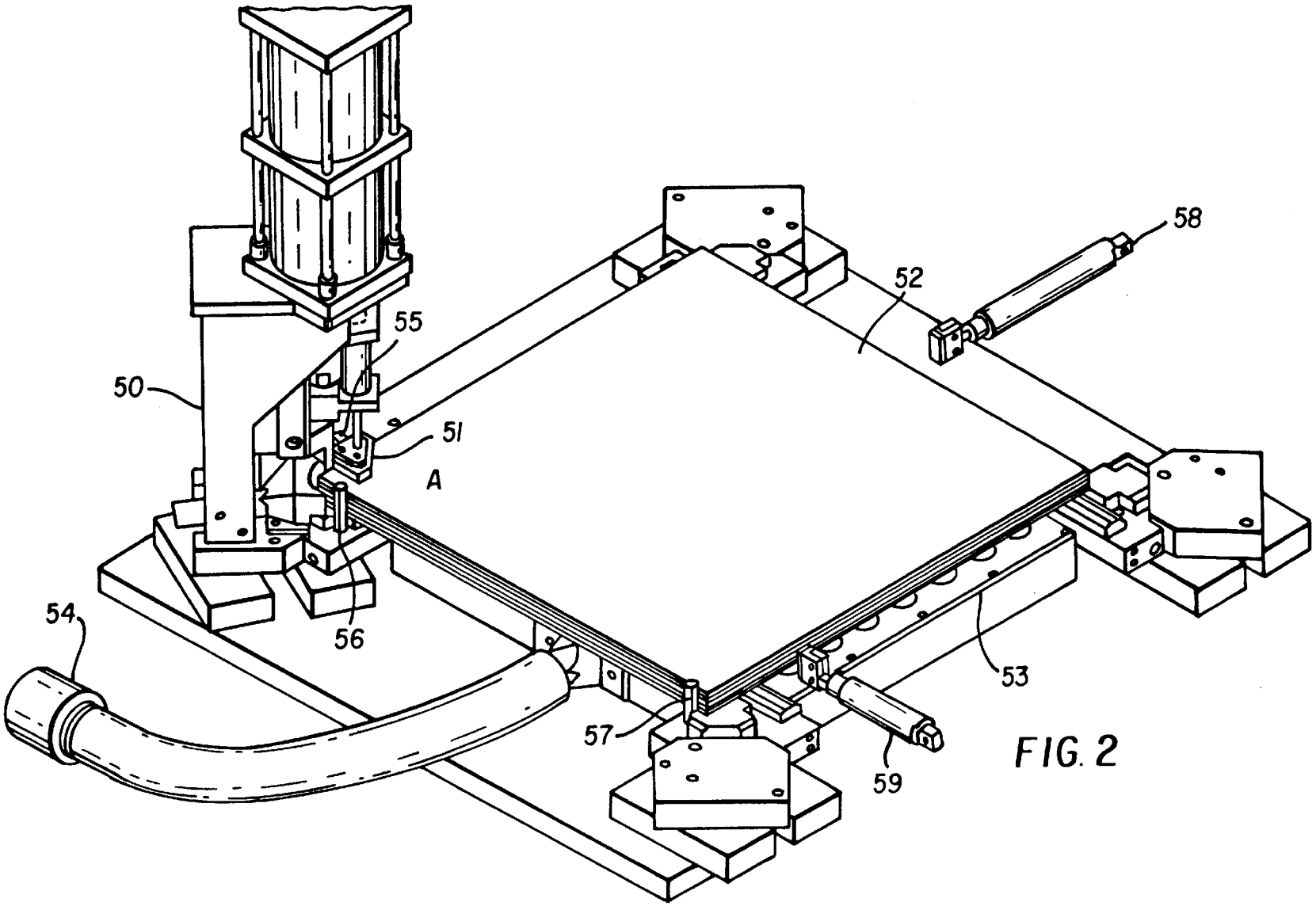
FIG. 2 shows a first embodiment of the device according to the present invention.

FIG. 2, to which reference is now made, shows a first embodiment of the device according to the present invention. This embodiment is particularly suited to piles of sheets having dimensions (width and length) which are substantially identical and makes it possible to produce the four rounded corners simultaneously after a single positioning operation.

The device comprises four cutting devices 50 (for reasons of clarity, only one of these devices is shown). These cutting devices are disposed at the four corners of a substantially rectangular surface, the dimensions of which (length and width) are at least equal to the respective maximum dimensions of the sheets. The cutting devices are, by way of example, of the punch/blanking die type, the said punches being controlled by a pneumatic jack. According to the embodiment shown, pressing means 51 are provided so as to press on the corresponding corner of the pile 52 so as to keep the sheets in the pile positioned before carrying out the cutting of the said corresponding rounded corner. Such cutting devices are well known in the art and consequently require no further description.

Figure 3:
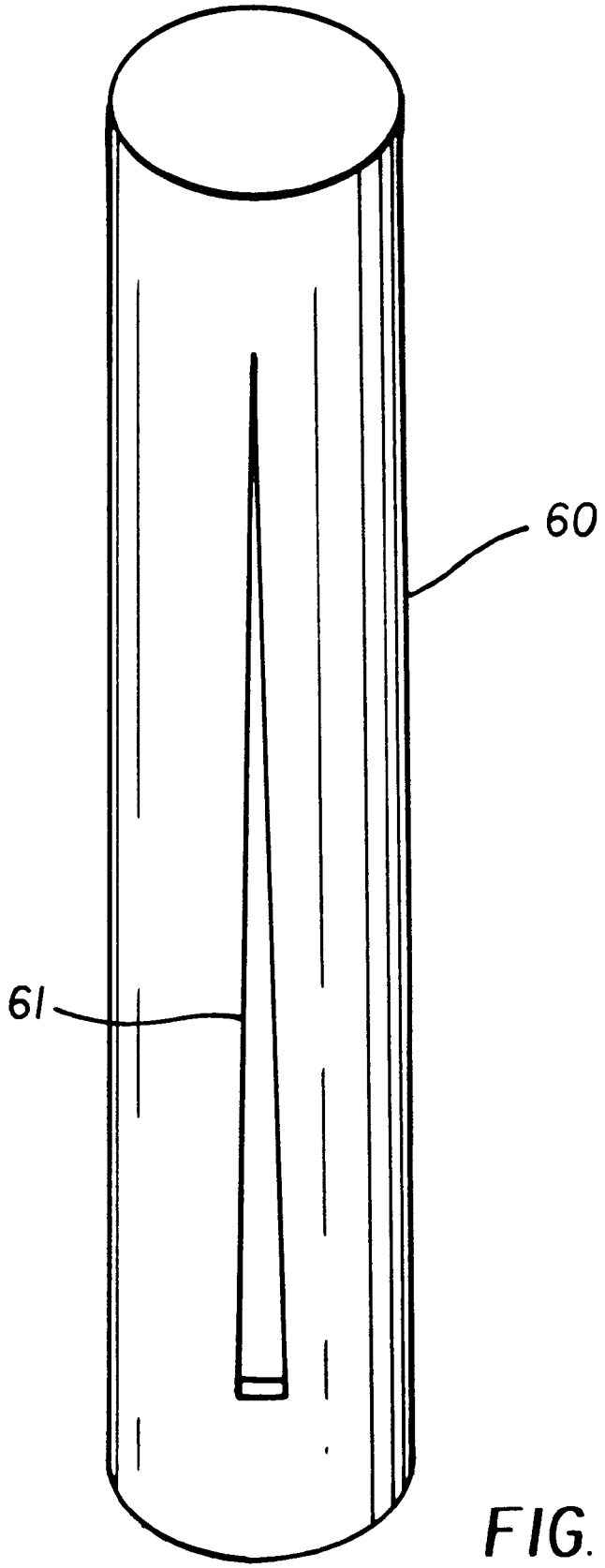
FIG. 3 is a diagrammatic representation of one of the devices intended to blow air between the sheets in the pile.

The device according to the present invention also comprises a support 53 intended to receive the pile of sheets. In a preferred embodiment this support defines a plane surface produced by the top part of at least one tubular chamber connected by suitable means 54 to a source of compressed air. Each chamber has on its top face a plurality of holes disposed so as to be distributed over substantially the entire surface of the pile. Such an arrangement makes it possible, when air is injected through the holes, to create a fluid film between the pile 52 and the support 53, thus facilitating the sliding and consequently the positioning of the pile against the reference surfaces, which will be discussed in more detail below. The device shown in FIG. 2 also comprises pins or studs 55, 56, 57 disposed so as to define at least one corner of the substantially rectangular surface, two reference surfaces being at right angles to each other to form the corner. According to the embodiment shown, these two reference surfaces are defined by three studs. These studs provide a mechanical stop for the stack. Two of these studs 55, 56 are disposed at one corner of the substantially rectangular surface (one of them 55 being partially concealed behind the pressing device 51), one stud being disposed facing each of the faces of the pile defining the corresponding corner. The third stud 57 is also disposed facing one of the faces of the pile defining the corner so as to define, in interaction with the other two studs, two bearing surfaces at right angles to each other. It is obvious that the greater the distance between the third stud 57 and the first two studs 55,56, the greater will be the accuracy of positioning of the sheets against the studs. The third stud 57 is, in the embodiment shown in FIG. 2, disposed approximately at a corner adjacent to the corner which has the first two studs. It is obvious that all these studs and all the devices described below which make up the positioning means must be at a distance from each of the corners which is at least equal to the radius of the rounded corners to be produced so as to allow the passage of the cutting tool. Studs 55,56,57 also comprise means, such as a nozzle, intended to direct compressed air over substantially the entire height of at least one of the edges of the pile of sheets. There are various possible arrangements of such means. By way of example, such a means is disposed facing one of the faces of the pile, substantially at the middle of the said face. According to another example, such means are disposed facing two faces of the pile, each one being disposed substantially at the middle of the corresponding face of the pile. In the embodiment shown in FIG. 2, these means intended to inject air also fulfil the mechanical stop function described above and, as shown in more detail in FIG. 3, studs 55,56,57 are in the form of a nozzle 60 consisting of a cylinder closed at both ends and connected to a source of air (not shown). Alternatively, as recognized by those skilled in the art referring to FIG. 3 will recognize that nozzle 60 can consist of a cylinder closed at one end and open at the other end allowing it to be connected to the source of air. The nozzle 60 has over substantially its entire length a narrow slot 61 enabling the jet of air to be distributed over the entire height of the said pile. Thus, studs 55,56,57 serve as a mechanical stop and reference surface to align the stack and also act as a nozzle to direct air against the stack. Preferentially, the narrow slot 61 is wider in the portion arranged facing the bottom part of the pile than in the portion facing the top part of the pile so as, because of the differences in forces exerted on the sheets at the top compared with the sheets at the bottom, to make the thickness of the lubricating fluid film created between each of the sheets in the pile uniform over the entire height of the pile. It is of course obvious that the number of nozzles to be used depends on their positioning, on the size of the sheets and on the height of the pile. In the embodiment shown in FIG. 2, each of studs 55, 56, 57 include nozzles and are, connected to a source of compressed air, the air preferably first being dried and filtered. As already mentioned, the three studs are disposed so as to define also the two reference surfaces described above.

The device according to the present invention also has translation components 58,59 which are adapted to move the stack in translation; the components 58, 59 being disposed facing and substantially perpendicular to at least two sides of the pile 52 and acting so as to position at least one corner A of the pile against the two reference surfaces as defined above. In FIG. 2, components 58,59 are illustrated as a pneumatic jacks disposed facing each of the faces of the pile, opposite those facing the two reference surfaces described above. The arrangement and number of such movable devices also depends on the size of the sheets. By way of example, two jacks are provided facing each of the said surfaces. During operation, the chambers forming the pile support and the studs 55, 56, 57 are supplied with compressed air so as to separate each sheet in the pile by means of a lubricating fluid film; the two pneumatic jacks 58, 59 are actuated so as to position one of the corners A of the pile of sheets against two perpendicular reference surfaces; finally the cutting devices are actuated at each of the four corners. Preferably, the four cutting devices 50 are actuated simultaneously. Such an arrangement is particularly suited where the sheets forming the pile are substantially of equal width and equal length, the four corners being perfectly positioned when any one of them is in abutment against two reference surfaces, substantially of equal width and equal length, resulting in differences between the sheets in any one pile not exceeding the tolerances allowed in the position and size of the rounded corner.

Figure 4:
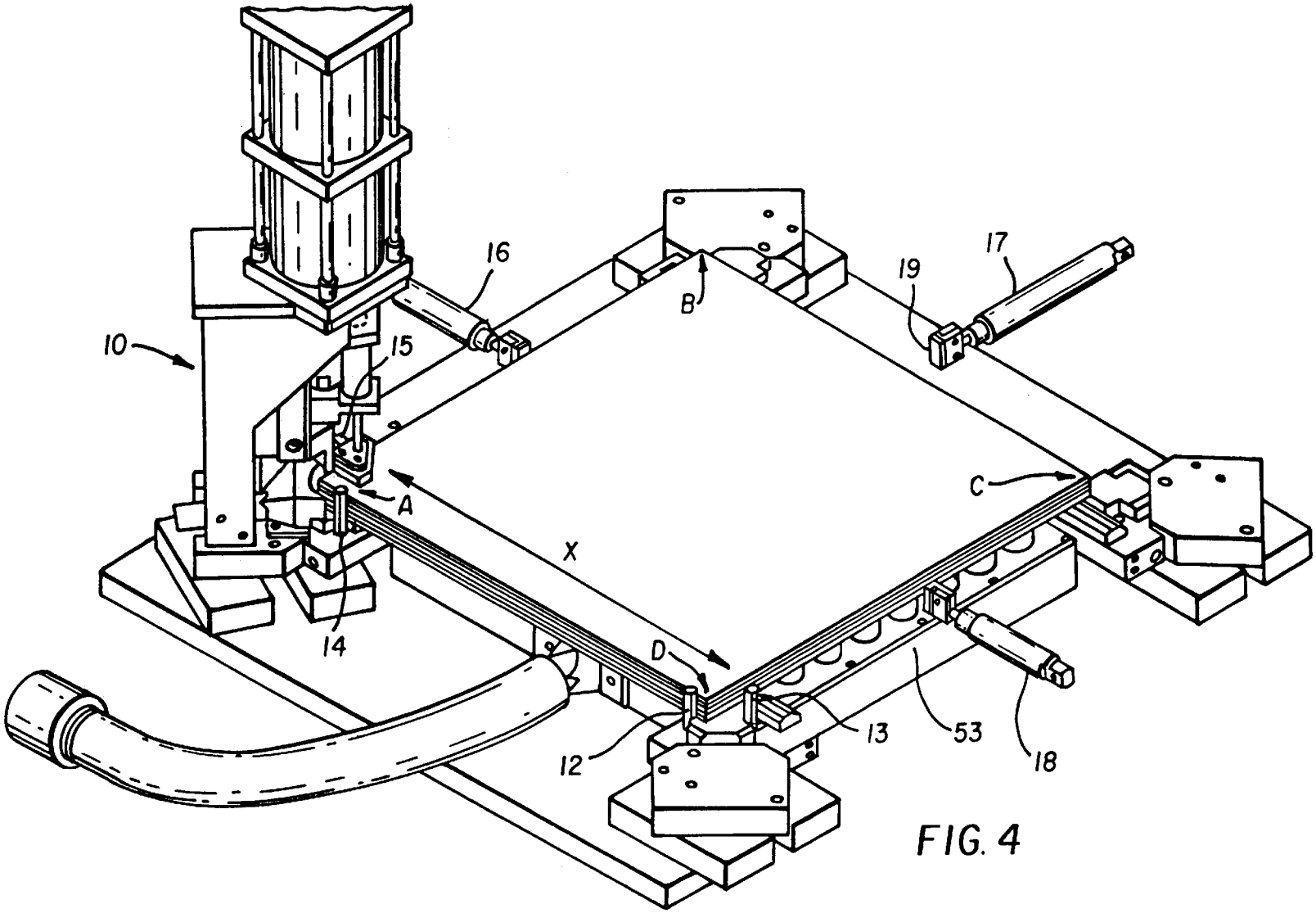
FIG. 4 shows a second embodiment of the device according to the present invention.
Figure 5:
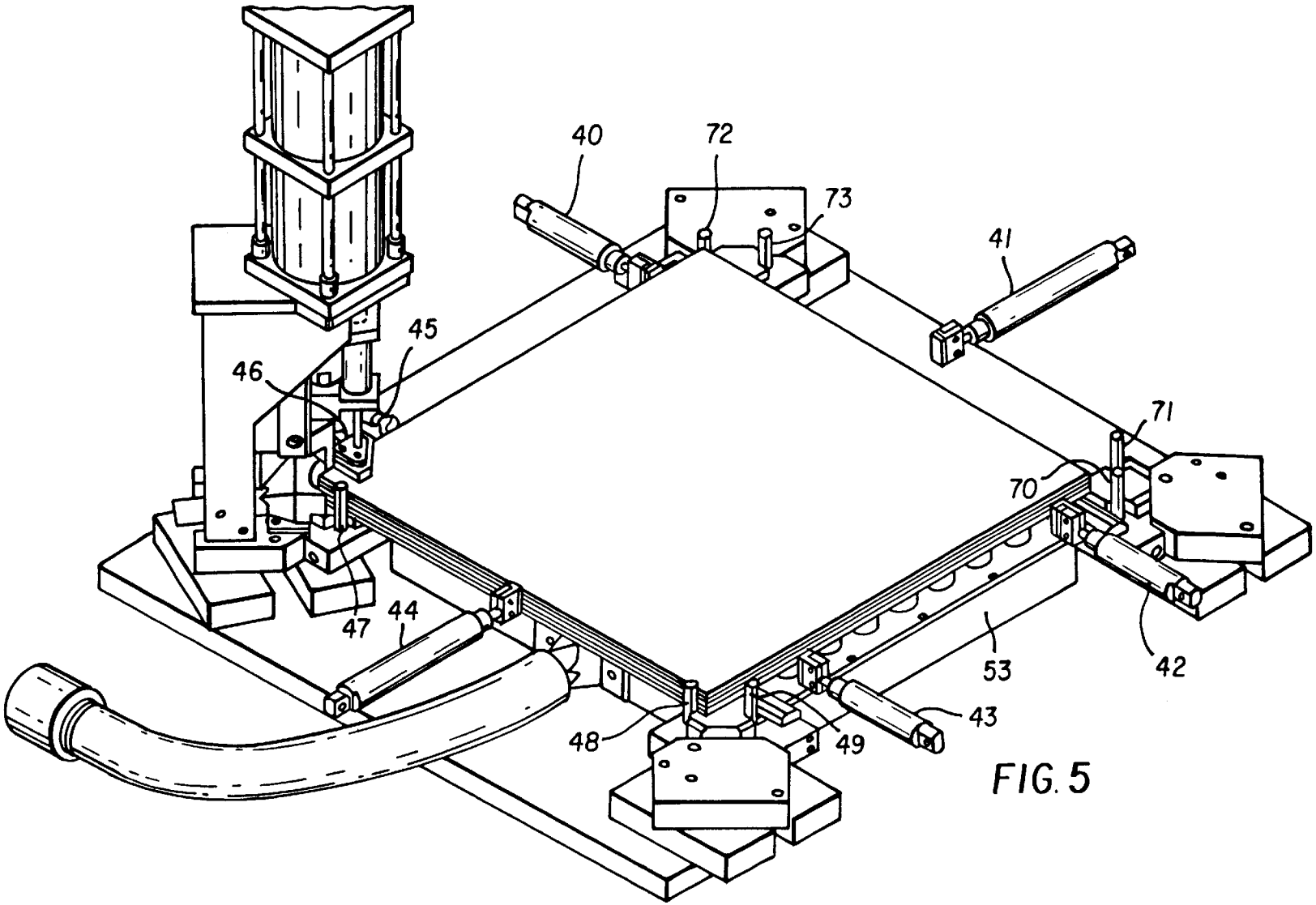
FIG. 5 shows yet another embodiment of the device according to the present invention.

FIG. 4, to which reference is now made, illustrates another embodiment of the present invention, particularly suited to piles of sheets, one of the dimensions of which (length or width, represented by the axis X) is variable from one sheet to another in the pile, the other dimension being substantially identical for all the sheets in the pile. According to this embodiment stud means 12, 13, 14, 15, forming a mechanical stop, are arranged in pairs so as to form two reference surfaces at a corner A, D of each end of the pile along the axis X of the variable dimension of the said sheets. In the same way as for the previous embodiment, the stud means 12,13,14,15 forming a stop preferably consist of nozzles connected to a source of compressed air making it possible, at least for some of them, in addition to the stop function, to inject air between the sheets in the said pile. In the embodiment shown in FIG. 4, the two pairs of reference surfaces are formed at two adjacent corners A, D of the substantially rectangular surface. According to another embodiment the two pairs of reference surfaces are formed at two opposite corners A, C of the pile. The three bearing points define a first pair of reference surfaces denoted by elements 46,47,48 for corner A, and elements 70,71,73 for corner C, as shown in FIG. 5.

The device also comprises movable translation components 16, 17, 18 disposed facing and substantially perpendicular to at least three sides of the pile acting in pairs so as to push two corners of the pile successively, in two directions at right angles to each other, against each of the pairs of corresponding reference surfaces.

Where the pairs of reference surfaces are disposed at two opposite corners of the substantially rectangular surface, for example A and C, it is obvious that the translations components movable in translation must be provided facing each of the faces of the packet of sheets. In the same way as in the previous embodiment, the movable translations components 16, 17, 18, consist of pneumatic jacks, and the end of the jacks in contact with the sheets can be provided with a pad 19 formed from a suitable flexible material, such as, for example, silicone, so as not to damage the edges of the sheets when the said jacks press on the said sheets. The embodiment shown provides for a single pneumatic jack disposed substantially at the middle of three of the faces of the packets of sheets. It is obvious that a greater number of them could be provided on each of the faces, depending in particular on the size of the sheets.

The steps of the method implemented by means of the device shown in FIG. 4 will be described starting from the case in which the variable dimension is the one along the axis shown diagrammatically by the double arrow X. In operation, the studs (with the nozzles forming a mechanical stop) 12, 13, 14, 15, and, the chambers forming the pile support are fed so as to create a lubricating film between each of the sheets; the corner A of the pile is placed in abutment against the studs 12, 14, 15, by moving the pneumatic jacks 17, 18 against the corresponding surfaces of the pile; the cutting devices 10 at the corners A and B are actuated simultaneously; the corner D is placed in abutment against the studs 12, 13, 14 by moving the pneumatic jacks 16, 17 against the corresponding surfaces of the pile; finally, the cutting devices 10 at the corners C and D are actuated simultaneously.

FIG. 5, to which reference is now made, shows another embodiment of the present invention, particularly suited to a pile of sheets in which both dimensions (length and width) are variable from one sheet to another in the pile. According to this embodiment, the stud means 46, 47, 48, 49, 70, 71, 72, 73, are arranged in pairs at each of the four corners of the substantially rectangular surface defined by the four cutting devices. Once again, at least some of the stud means forming a mechanical stop preferably consist of nozzles connected to a source of compressed air thus making it possible, in addition to the stop function, to inject air between the sheets in the said pile. According to another embodiment, the stud means forming a mechanical stop are separate from the means enabling air to be blown between the sheets. Components which are movable in translation 40, 41, 42, 43, 44, 45, are disposed facing each face of the pile so as to place each corner of the pile successively in abutment against the two corresponding reference surfaces. According to the embodiment shown in FIG. 5, two of the faces of the pile are facing two movable components (one of them 45 being hidden by the cutting device shown), the two other faces of the pile being facing a single movable component disposed substantially at the middle of the corresponding face of the packet of sheets.

Figure 6:
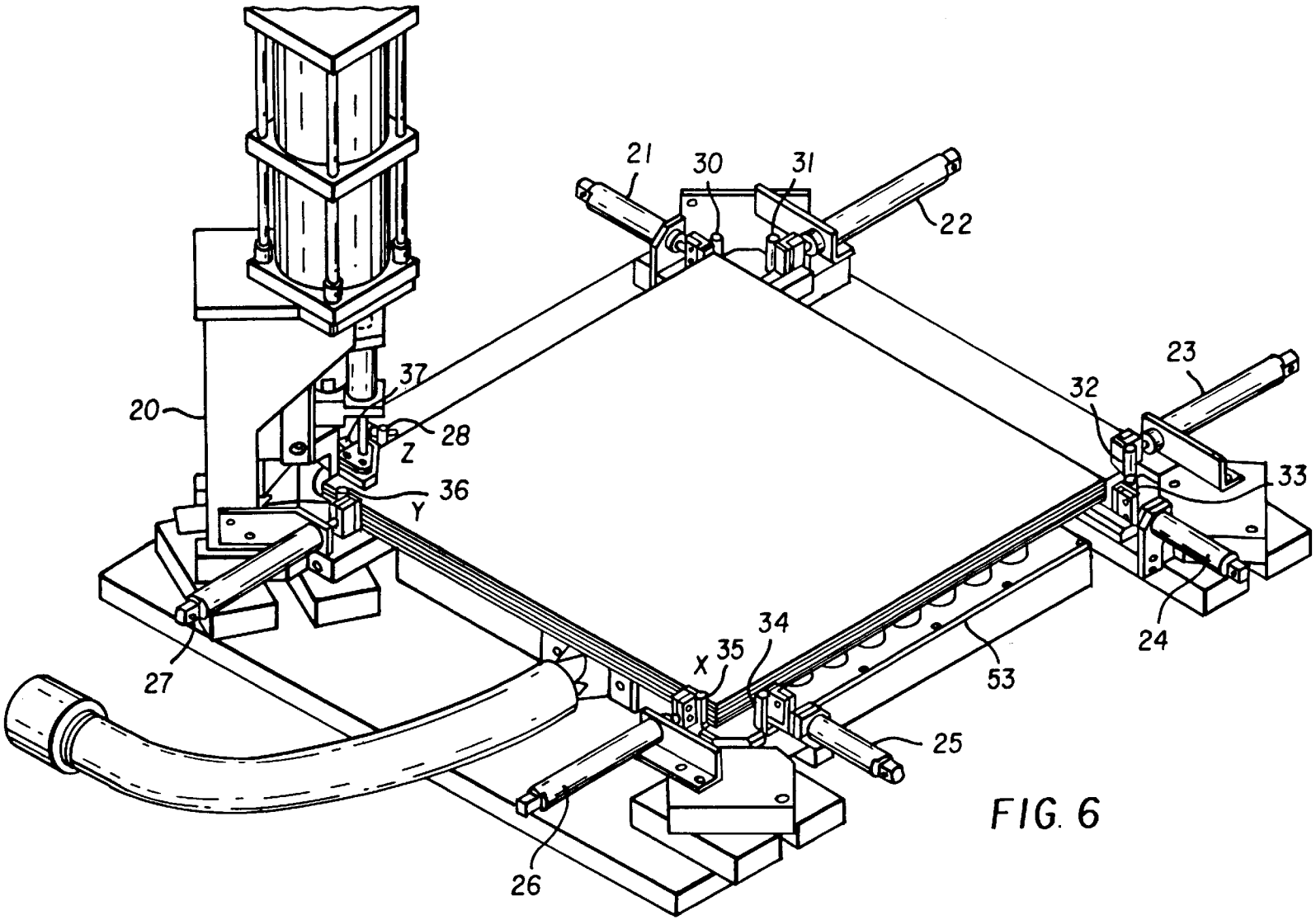
FIG. 6 shows a variant of the embodiment of FIG. 5.

In FIG. 6, which shows a variant of the embodiment of FIG. 5, the components movable in translation 21–28 are disposed in pairs at each of the four corners of the device, close to the stud components 30,31,32,33,34,35,36,37 forming a mechanical stop. Advantageously, at least some of the stud components forming a stop can, in addition to blowing air between the sheets, be movable in translation so that it is no longer necessary to provide auxiliary movable means.

Figure 7:
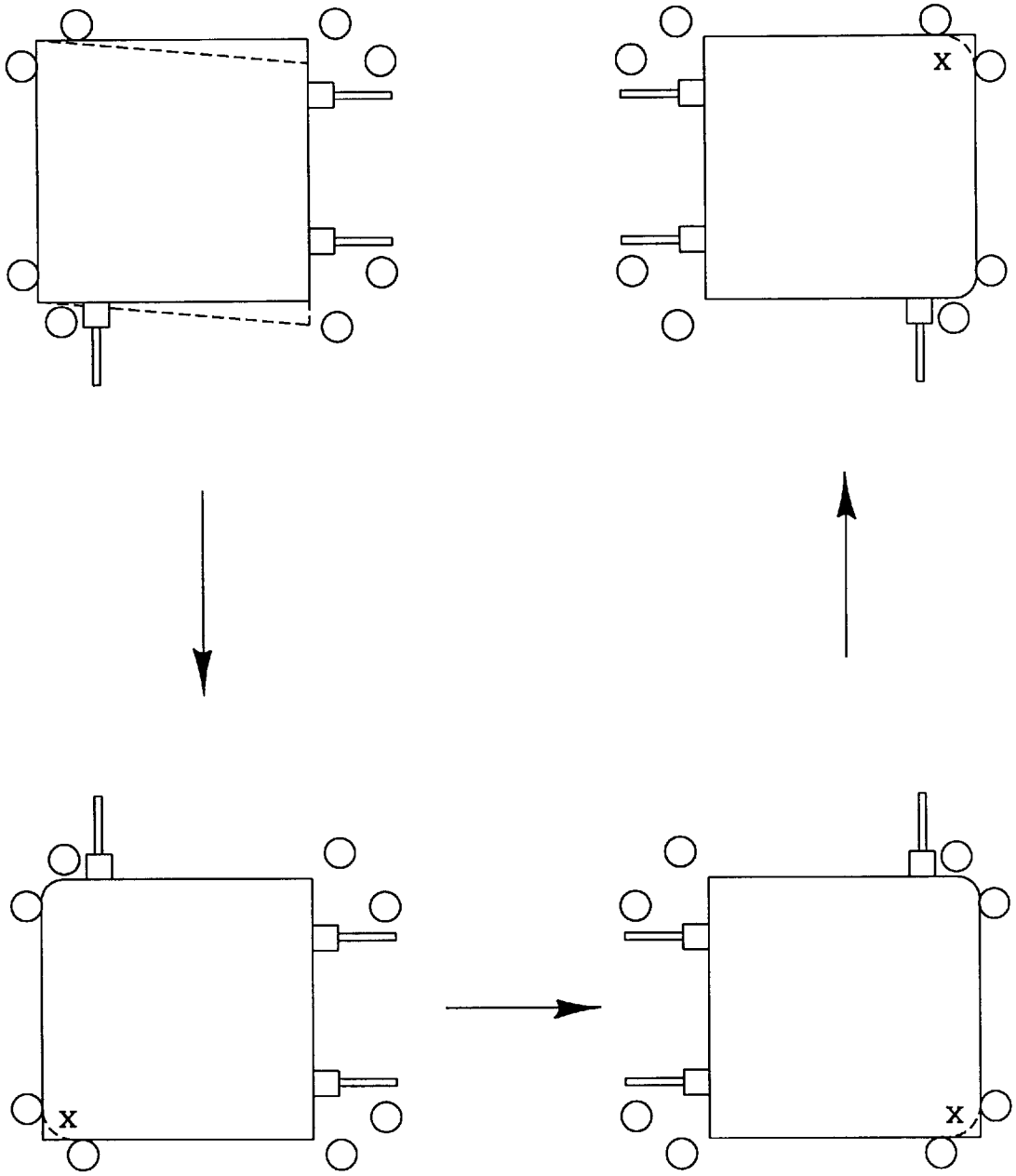
FIG. 7 illustrates diagrammatically the steps of the method implemented by the device of FIG. 6.

During the operation of such an embodiment, after supplying with compressed air the eight stud components intended for this purpose, as well as, if applicable, the chambers forming the support of the device, the movable translation components 22, 23 and 25 are actuated so as to place the pile in abutment against the stud components forming a stop, letters X, Y and Z defining two reference surfaces at right angles to each other forming a first corner. A cutting device 20 corresponding to the first corner is actuated. The same operations are repeated successively for the other three corners of the pile. These different steps are illustrated more plainly in FIG. 7, the symbol X representing, for each step of the method, the cutting device to be actuated.

In all the above description, certain components such as, for example, the pile support and the cutting devices, are common to all the embodiments and in consequence have not been described systematically for each of the embodiments mentioned.

In all the embodiments described in which the sheets have at least one of their dimensions variable from one sheet to another in the pile, the ends of the movable components in contact with the sheets are provided with suitable means enabling the variations in dimension to be absorbed. By way of example, for relatively small variations (of the order of 2 mm) a polyurethane foam, whose thickness is in accordance with the said variations in dimension, is disposed at the ends of the said movable components. For greater differences between the sheets, a nylon brush, whose density and length of bristle depends on the thickness of the sheets and the dimensional differences, can be disposed at the ends of the said movable components. The action of such means, combined with the lubricating fluid film between each of the sheets, makes it possible to compensate for variations in dimension which may be as much as 2 cm or more.

What is claimed is:

1. A method for shaping a plurality of sheets forming a stack, each sheet having four edges and four corners to be shaped, said the method comprising the steps of:

positioning four cutting devices adjacent a surface, each one of the four cutting devices being proximate a respective one of the four corners;

injecting air between the sheets of the stack;

translating the stack in a first direction and then in a second direction to a first position, respectively, to position a first edge of the stack abutting a first and second mechanical stop and to position a second edge of the stack abutting a third mechanical stop, the first direction being orthogonal to the second direction;

actuating a first pair of the four cutting devices, when the stack is in the first position, to shape a first and second corner of the sheets;

applying a force on the stack in a third direction and in the first direction to position, through translation, the third edge of the stack against a fourth mechanical stop and to maintain the first edge of the stack in abutment against the first and second mechanical stops so as to position a second of the four corners adjacent a second of the four cutting devices, the first direction being substantially orthogonal to the third direction, the third direction being opposite and substantially parallel to the second direction; and actuating a second pair of the four cutting devices, when the stack is in the second position, to shape a third and fourth corner of the sheets.

2. A method for shaping a plurality of sheets forming a stack, each sheet having four edges and four corners to be shaped, said method comprising the steps of:

positioning four cutting devices adjacent a surface, each one of the four cutting devices being proximate a respective one of the four corners;

injecting air between the sheets of the stack;

translating the stack in a first direction and then in a second direction, respectively, to first abut a first edge of the stack against a first and second reference surface and then to abut a second edge of the stack against a third reference surface so as to position a first of the four corners adjacent a first of the four cutting devices, the first direction being substantially orthogonal to the second direction;

actuating the first of the four cutting devices to shape the first of the four corners after positioning the first of the four corners adjacent the first of the four cutting devices;

applying a force on the stack in a third direction and in the first direction to position, through translation, the third edge of the stack against a fourth reference surface and to maintain the first edge of the stack in abutment against the first and second reference surface so as to position a second of the four corners adjacent a second of the four cutting devices, the first direction being substantially orthogonal to the third direction, the third direction being opposite and substantially parallel to the second direction;

actuating the second of the four cutting devices to shape the second corner after positioning the second of the four corners adjacent the second of the four cutting devices;

translating the stack in the fourth direction and then in the third direction, respectively, to first abut a fourth edge of the stack against a fifth and sixth reference surface and then to abut the third edge of the stack against a seventh reference surface so as to position a third of the four corners adjacent a third of the four cutting devices, the third direction being substantially orthogonal to the fourth direction, the fourth direction being opposite and substantially parallel to the first direction;

actuating the third of the four cutting devices to shape the third corner after positioning the third of the four corners adjacent the third of the four cutting devices;

applying a force on the stack in the second direction and in the fourth direction to position, by translation, the second edge of the stack against an eighth reference surface and to maintain the fourth edge of the stack in abutment against the fifth and sixth reference surfaces so as to position a fourth of the four corners adjacent a fourth of the four cutting devices, the second direction being substantially orthogonal to the fourth direction; and actuating the fourth of the four cutting devices to shape the fourth corner after positioning the fourth of the four corners adjacent the fourth of the four cutting devices.

3. A method for shaping a plurality of sheets forming a stack, each sheet having four corners to be shaped and four edges, a first and second of the four edges being adjacent, the first and a third edge being adjacent, comprising:

providing four shaping devices adjacent a surface, each one of the four cutting devices being proximate a respective one of the four corners;

injecting air between the sheets of the stack;

translating the sheets in a first direction to position a first edge against a first and second stationary mechanical stop, the first and second mechanical stops being spaced apart;

translating the sheets in a second direction to position a second edge against a third stationary mechanical stop, the second direction being substantially orthogonal to the first direction;

after translating the sheets in the first and second directions, actuating a first pair of the four shaping devices to shape a first and second corner of the sheets;

translating the sheets in a third direction to position a third edge against a fourth stationary mechanical stop, the third direction being substantially parallel to the second direction and directed away from the third mechanical stop, the mechanical stops being spaced apart from the four corners; and after translating the sheets in the third direction, actuating a second pair of the four shaping devices to shape a third and fourth corner of the sheets.

* * * * *